US006152784A

United States Patent [19]

Pyles

[11] Patent Number: 6,152,784

[45] Date of Patent: Nov. 28, 2000

[54] ELECTRIC STORAGE BATTERY CONNECTOR ASSEMBLY

[76] Inventor: Felix A. Pyles, 1031 Keystone Ct., Charlotte, N.C. 28210

[21] Appl. No.: 09/417,703

[22] Filed: Oct. 13, 1999

Related U.S. Application Data

[63] Continuation of application No. 09/146,005, Sep. 2, 1998, Pat. No. 5,980,334.

[51] Int. Cl.[7] ..... H01R 4/42

[52] U.S. Cl. ..... 439/764; 439/442

[58] Field of Search ..... 439/794, 523, 439/770, 772, 773, 889

[56] References Cited

U.S. PATENT DOCUMENTS

| | | | |
|---|---|---|---|
| 1,665,048 | 4/1928 | Weimer | 439/770 |
| 1,671,799 | 6/1928 | Richardson | 439/770 |
| 1,674,799 | 6/1928 | Richardson | 439/770 |
| 2,952,830 | 9/1960 | Sperzel et al. | 439/889 |
| 3,689,866 | 9/1972 | Kelly | 439/889 |
| 4,576,430 | 3/1986 | Dufresne | 439/772 |
| 4,702,539 | 10/1987 | Cusick, III et al. | 439/588 |
| 5,024,619 | 6/1991 | Caraballo | 439/773 |
| 5,062,812 | 11/1991 | Allen | 439/756 |

OTHER PUBLICATIONS

"Battery Builders Electromagnetic Heat Seal"; Battery Builders, Inc., Entire Brochure; Sep., 1998.

"Powerline–A Powerful Solution for Maximum Efficiency"; KW Powersource, Inc.; Entire brochure; Apr., 1994.

"Classic Motive Power Batteries"; KW Powersource, Inc.; Entire brochure; Apr., 1994.

"The Power Connection"; Douglas Battery Manufacturing Co.; Entire brochure; Sep., 1998.

"Daewoo Lift Trucks–BC25S/B25S Series"; Daewoo Lift Trucks; Entire brochure; Jan., 1996.

"Bulldog Battery Corporation–Battery Selection Guide"; Bulldog Battery Corporation; Entire brochure; Sep., 1998.

"Led–Hed Battery Connectors–A New and Economical Way to change Industrial Battery Cables"; Brad Harrison Company; Entire brochure; Sep., 1998.

"CT Terminal–Quick Change Battery Cable Connector"; KW Powersource, Inc.; Entire brochure; Dec., 1993.

Panduit Package Label; Apr., 1996.

*Primary Examiner*—T. C. Patel

*Attorney, Agent, or Firm*—Adams, Schwartz & Evans, P.A.

[57] ABSTRACT

An electric storage battery connector assembly, including a male connector, which includes an elongate, generally cylindrical, electrically-conductive post having a fixed end for being attached to an electrical cable and a free end. A female connector electrically communicates with a terminal of the battery. The female connector is formed of an electrically-conductive material and has a recess therein for receiving therein the post of the male connector. A cam is integrally-formed on the free end of the post of the male connector, and a cam follower is carried in the recess of the female connector for cooperating with the cam on the post of the male connector for relative rotational movement between the unlocked position where the post may be inserted into or removed from the recess in the female connector, and the locked position where the post is locked into the recess of the female connector against removal therefrom.

9 Claims, 6 Drawing Sheets

ELECTRIC STORAGE BATTERY CONNECTOR ASSEMBLY

This application is a continuation application of U.S. Ser. No. 09/146,005 filed Sep. 2, 1998 now U.S. Pat. No. 5,980,334.

TECHNICAL FIELD AND BACKGROUND OF THE INVENTION

This invention relates to an electric storage battery connector assembly. One principal use of this novel connector assembly is for use with motive power traction batteries such as used on forklift and similar vehicles. Such vehicles generally utilize large arrays of powerful storage batteries connected by heavy-duty cables to electric traction drive motors and hydraulic motors. These batteries generally operate at 36 or 48 volts.

Most prior art cable connectors are integrally-formed lead housings which connect the cable to the battery terminals. These lead housings are called "lead heads" and are "burned in" at the battery factory. "Burned in" is a term which essentially refers to a type of lead welding, and results in a unitary structure. Once the cable has been burned in, it is an integral part of the battery.

If a battery cable is cut or damaged, the battery is out of service until repairs are made. This requires that the lead head be cut off of the battery and a new lead head burned in. This can require a significant amount of time and expense. In addition, equipment for melting and pouring lead is required, which not only increases expense also requires handling molten lead—an obvious safety hazard.

In addition, there are many different types of lead heads in different sizes and configurations and amp capacities. In many instances, the correct replacement lead head may not be readily available.

One improvement over the typical prior art method requires the factory cable be cut at the post, and then the conventional factory lead head removed with a hollow post drill. A clamp with a connector attached is burned onto the terminal and provides a means of releasably attaching a battery cable to the battery terminal. The cable is attached to the clamp with a set screw which is tightened and loosened with a hex wrench. This system is manufactured by Brad Harrison Company, Northbrook, Ill., under the trademark "Led-Hed."

This system also presents disadvantages, since it still requires forming a lead head with molten lead, albeit only once for each battery. In addition, five different types of battery connector s.

The present invention eliminates all of these problems, by reducing repair time, reducing labor and materials costs, and improving safety.

SUMMARY OF THE INVENTION

Therefore, it is an object of the invention to provide an electric storage battery connector assembly.

It is another object of the invention to provide an electric storage battery connector assembly intended for motive power traction batteries such as used on forklift and similar vehicles.

It is another object of the invention to provide an electric storage battery connector assembly whereby battery cables can be easily and quickly removed from batteries and replaced.

It is another object of the invention to provide an electric storage battery connector assembly which enhances safety by eliminating the need to use molten lead.

It is another object of the invention to provide an electric storage battery connector assembly which reduces corrosion at connection points.

It is another object of the invention to provide an electric storage battery connector assembly which is usable with virtually any type of electric storage battery.

These and other objects of the present invention are achieved in the preferred embodiments disclosed below by providing an electric storage battery connector assembly, comprising a male connector, which includes an elongate, generally cylindrical, electrically-conductive post having a fixed end for being attached to an electrical cable and a free end. A female connector electrically communicates with a terminal of the battery. The female connector is formed of an electrically-conductive material and having a recess therein for receiving therein the post of the male connector. Cam means are integrally-formed on the free end of the post of the male connector, and cam follower means are carried in the recess of the female connector for cooperating with the cam on the post of the male connector for relative rotational movement between the unlocked position where the post may be inserted into or removed from the recess in the female connector, and the locked position where the post is locked into the recess of the female connector against removal therefrom.

According to one preferred embodiment of the invention, the post of the male connector and walls of the recess of the female connector comprise copper.

According to another preferred embodiment of the invention, an insulator is provided for being positioned in overlying relation on the male connector and female connector when in a locked position.

According to yet another preferred embodiment of the invention, the insulator comprises a heat-shrinkable plastic.

According to yet another preferred embodiment of the invention, the cam means of the post comprises a generally annular nose having a flat side for allowing the post to move pass the cam follower, and an annular groove of reduced diameter extending around the periphery of the post in communication with the flat side of the nose for receiving the cam follower as the post is rotated.

According to yet another preferred embodiment of the invention, the female connector is embedded in a lead housing for being connected to the battery terminal.

According to yet another preferred embodiment of the invention, the female connector is embedded in the battery terminal.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
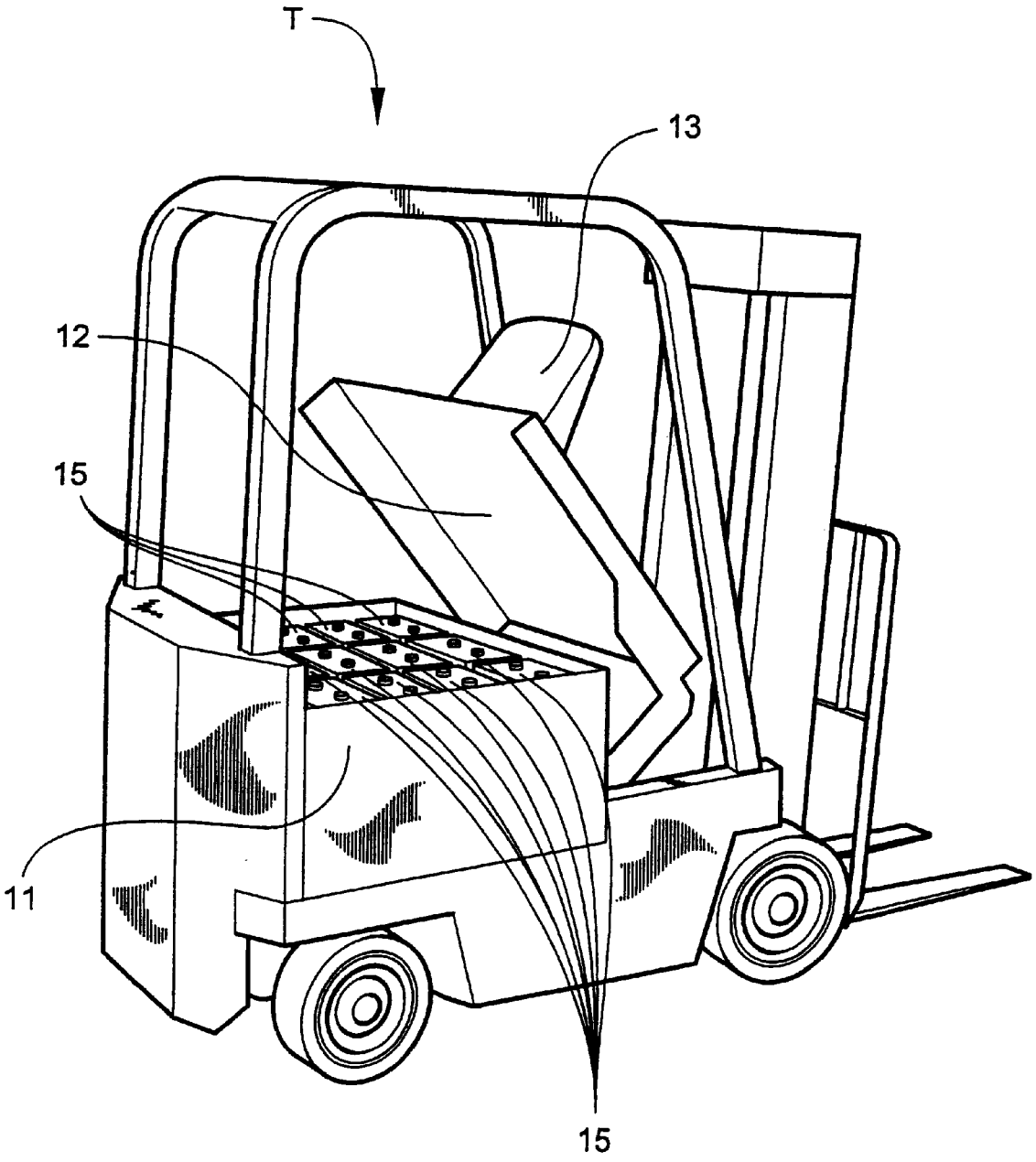
FIG. 1 is a perspective view of a forklift truck of the type with which one embodiment of the invention may be used.

Referring now specifically to the drawings, a forklift trick T of the type which used heavy duty electric storage batteries is shown. The truck T includes a battery compartment 11 with a tiltable cover 12, on the top surface of which is the operator's seat 13. Storage battery cells 15 15 are positioned in the battery compartment 11 and are electrically interconnected with each other. Each battery cell 15 represents 2 Volts, so that, for example, a 48 Volt system has 24 battery cells, each with two 2-Volt cells.

Figure 2:
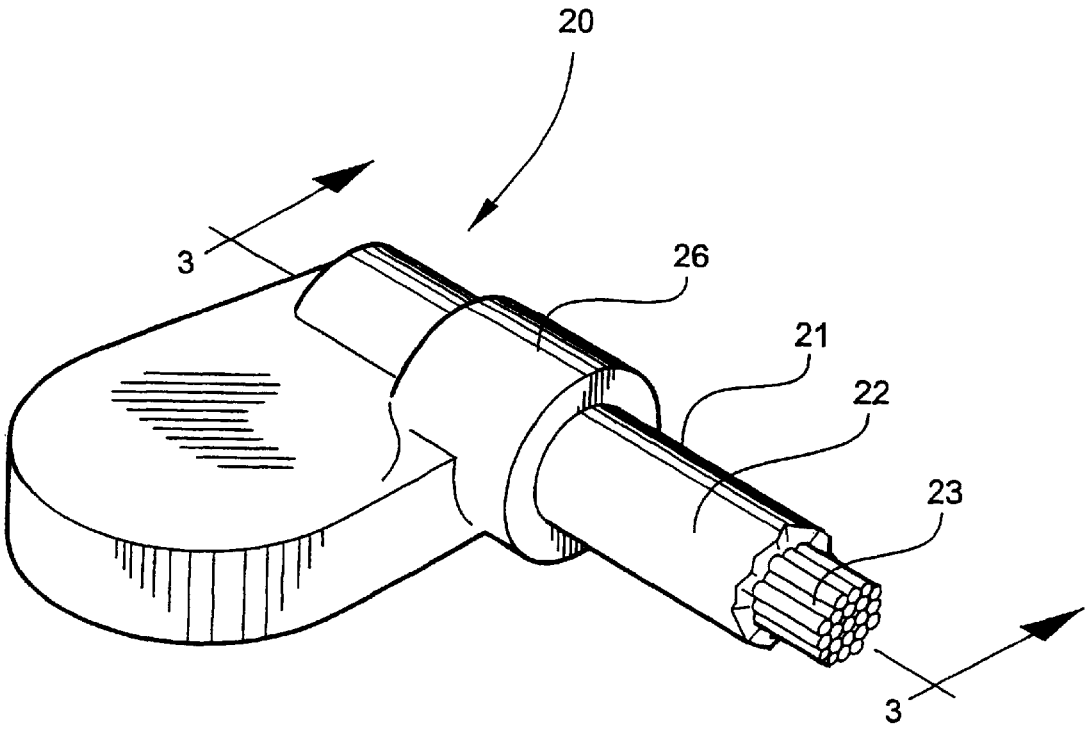
Fig. 2 (Prior Art)
FIGS. 2 and 3 are perspective and vertical cross-sectional views, respectively, of a prior art lead head cable attachment device.
Figure 3:
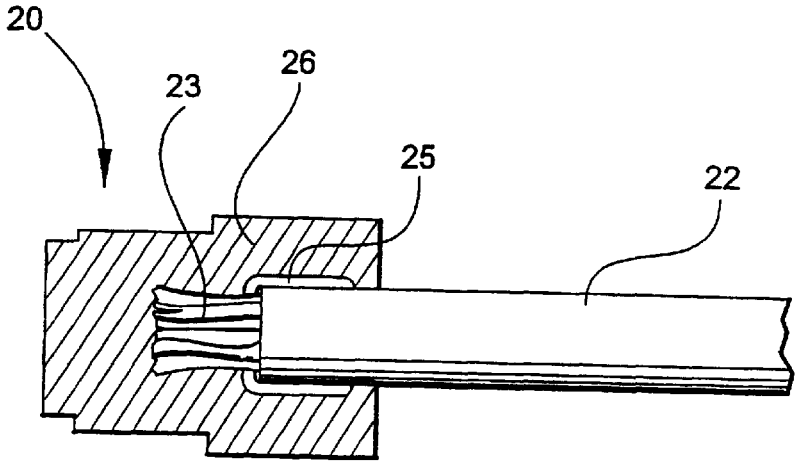
Fig. 3 (Prior Art)
Figure 4:
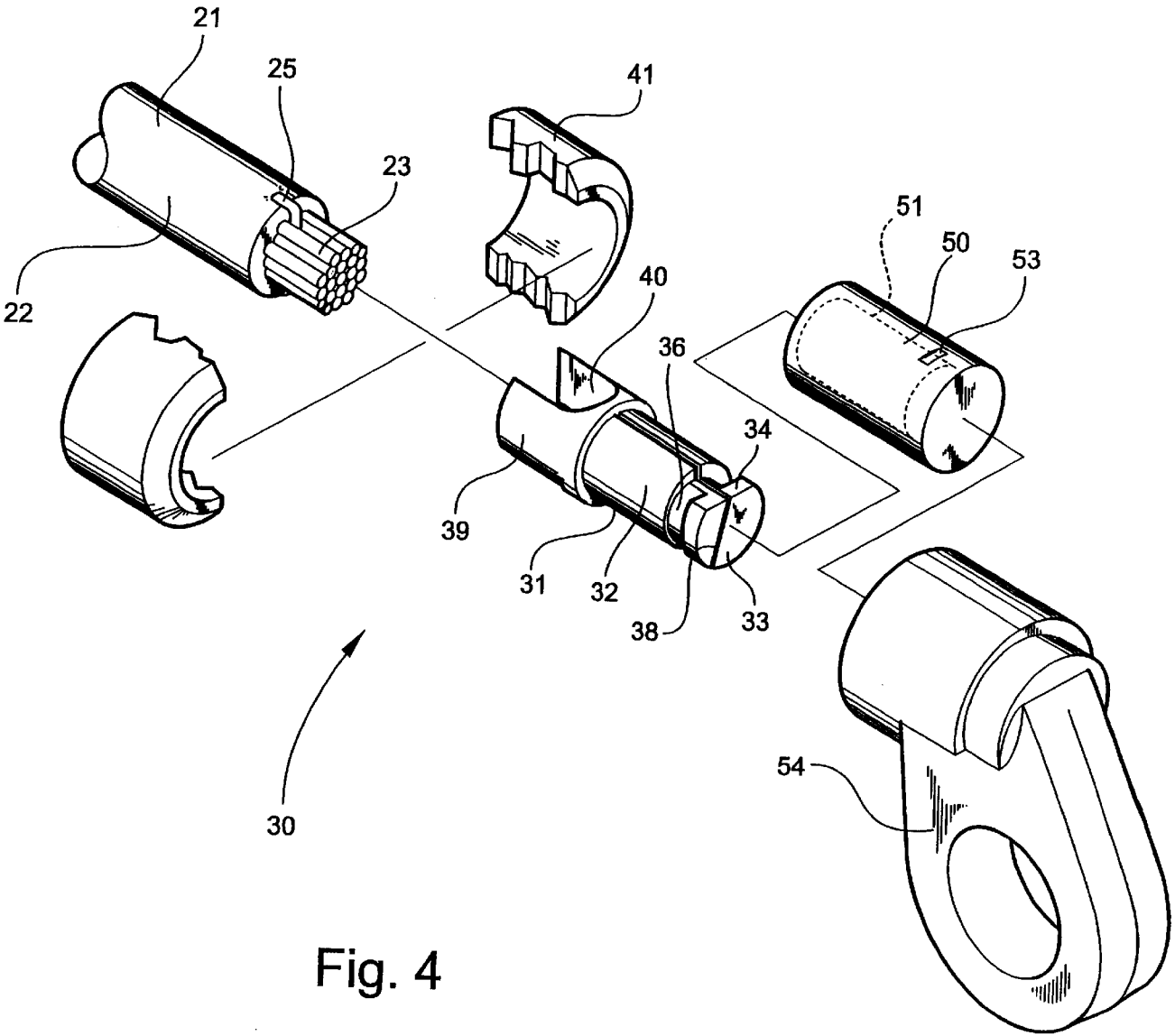
FIG. 4 is an exploded view of battery connector assembly according to a preferred embodiment of the invention.

As is shown in FIGS. 2 and 3, a prior art lead head 20 is shown. The lead head 20 connects a battery cable 21 to the battery terminal (not shown) and is integrally-formed as a unit. Thc cable 21 is formed of a heavy rubber or plastic dielectric cover 22 surrounding a plurality of parallel, bundled copper wires 23. The wires 23 are held in position relative to the cover 22 by a hog ring 25 which extends through the bundle of wires 23 and through the cover 22. A lead collar 26 encloses the end of the cable 21. Referring now to FIG. 4, a battery connector assembly according to an embodiment of the invention is shown at reference numeral 30. A male connector 31 is formed of copper and includes a post 32. A cam 33 is integrally formed on the free end of the post 32 and includes a flat side 34. An asymmetric annular groove 36 of reduced diameter separates the cam 33 from the remainder of the post 32. By "asymmetric" is meant that the groove is eccentric with relation to the longitudinal axis of the post 32, as described in further detail below. An elongate gap 38 extended the length of the post 32.

An enlarged-diameter fastener 39 is integrally-formed on the post 32, the walls of which define a cavity 40. The exposed wires 23 are extended into this cavity 40, and a lead collar 41 is molded around the fastener 39 and the wires 23.

Figure 5:
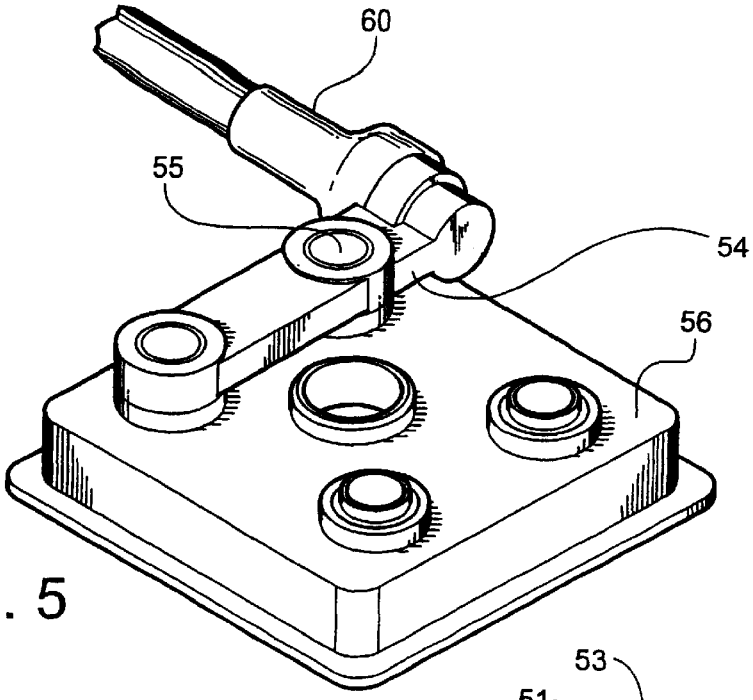
FIG. 5 is a perspective view of the battery connector assembly shown in FIG. 4 on a battery.

A female connector 50 comprises a cylindrical member, the inner walls of which define a recess 51 sized to received the post 32 of the male connector 31. An lug 53 projects inwardly into the recess 51 and acts as a cam follower in the asymmetric groove 36. The female connector 50 is embedded into a ring-clamp 54 which is fitted over the terminal 55 of a battery cover 56, as is shown in FIG. 5.

The male connector 31 and the female connector 50 are disclosed in a distinctly different environment in U.S. Pat. No. 4,702,539. The '539 patent discloses a cable connector assembly used to connect lengths of electrical cable to each other to make a longer cable. This invention discloses the electrical equivalent of connecting water hoses together to form a longer hose. The male and female connectors in the '539 patent both have resilient outer casings which are compressed against each other when they are connected.

Figure 6A:
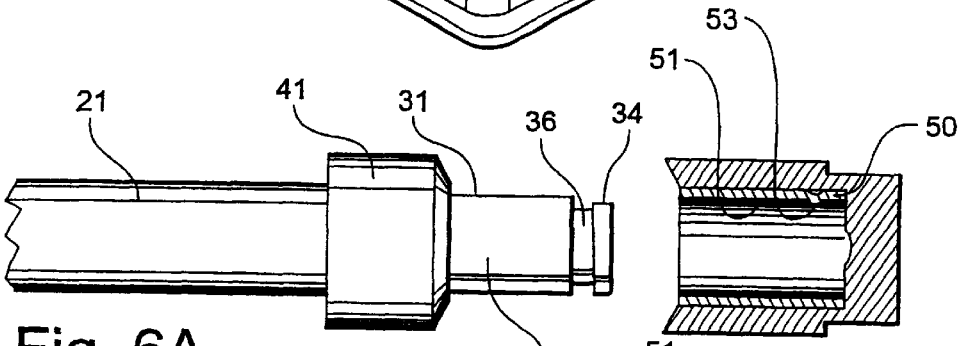
FIGS. 6A, 6B and 6C are sequential vertical cross sectional views of the male connector being locked into position in the female connector.
Figure 6B:
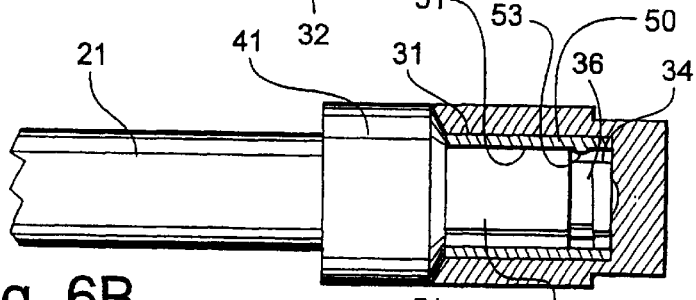
Figure 6C:
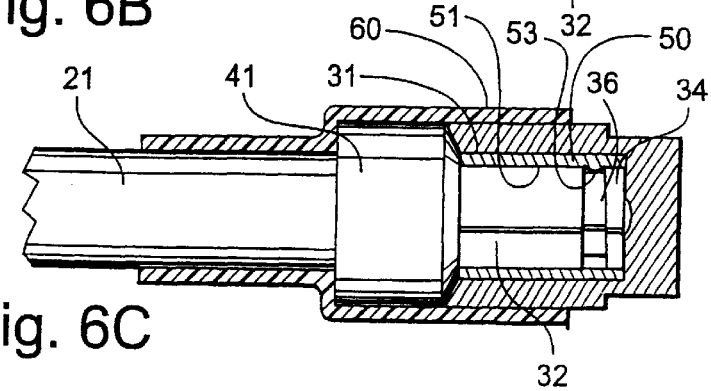

As is shown in FIGS. 6A–6C, post 32 is inserted into the recess 51 of the female connector 50. Post 32 is oriented so that the flat side 34 is radially aligned with the lug 53, so that post 32 is permitted to pass by the lug 53. FIG. 6A. When the post 32 bottoms out at the end of the recess 51, the lug 53 is axially aligned with the groove 36. FIG. 6B. The male connector 31 is then rotated 180 degrees. This causes the asymmetric groove 36 to wedge against the lug 53 in a camming action which locks the male connector 31 into the female connector 50. FIG. 6C. The gap 38 provides a linear spring action which permits a secure locking position with less resistance and improved electrical contact.

Rotation of more than 180 degrees is prevented. For this reason, counterrotation of the male connector 31 must be accomplished to unlock the male and female connectors from each other.

Once the connection is properly made, a tubular insulator 60 in the form of a sleeve is placed over the joined connectors 31 and 50. Preferably, a heat-shrinkable material is used. One preferred product is Panduit HSTI. 1-9-2, 1.1 inch polyolefin. The shrinkage of the insulator 60 is effected by, for example, a propane torch.

Figure 7:
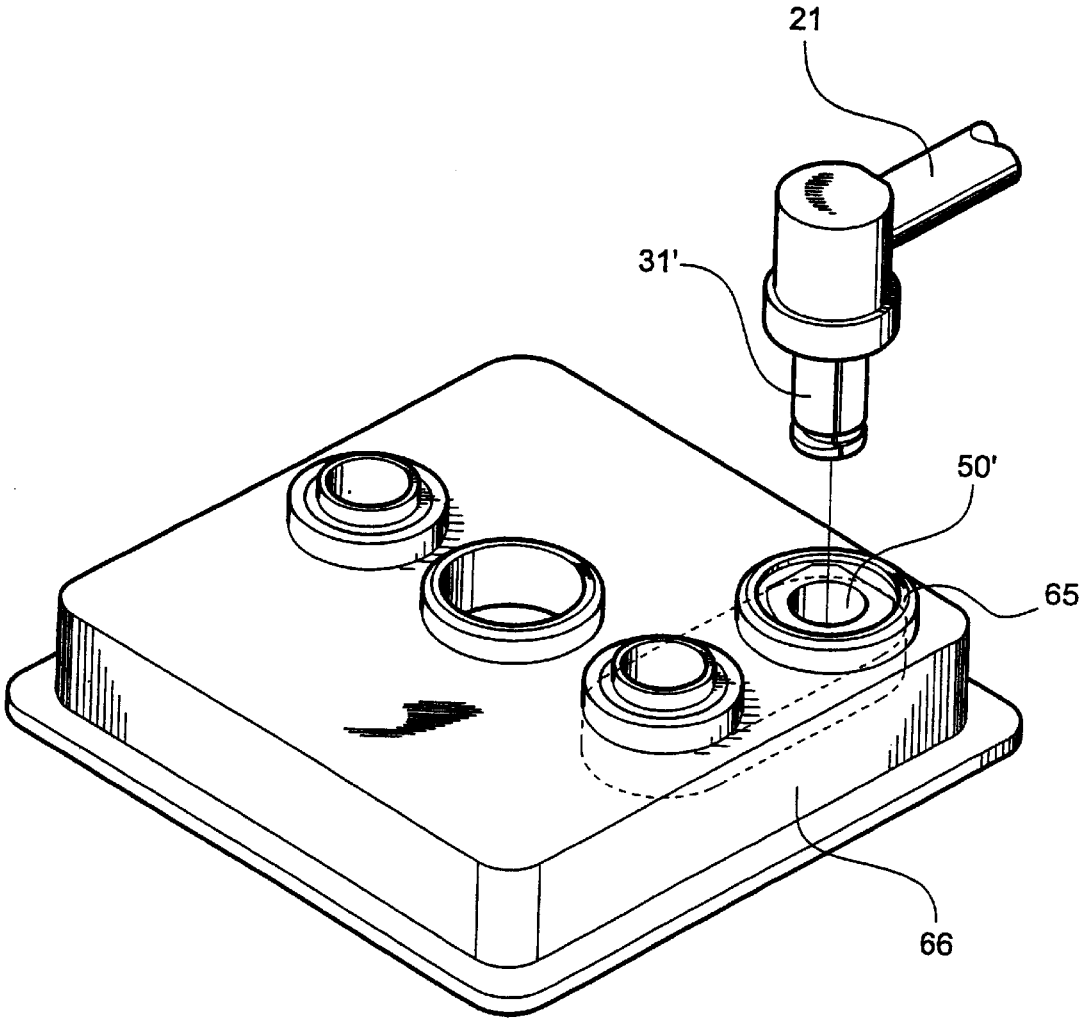
FIG. 7 is a perspective view of another embodiment of the invention.
Figure 8:
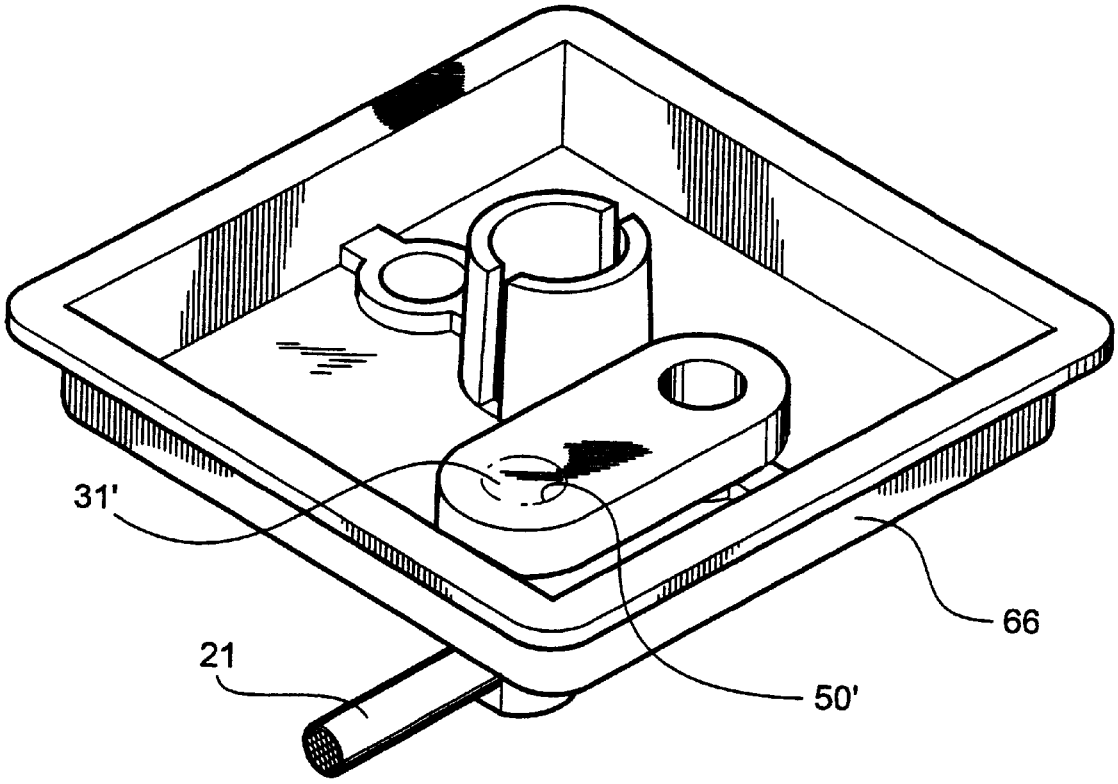
FIG. 8 is a perspective view of the underside of the battery cover shown in FIG. 7.

Referring now to FIGS. 7 and 8, a male connector 31' is formed in a right-angle configuration and is positioned in a female connector 50' which is formed directly into a terminal 65 of a battery cover 66. This provides a particularly simple and efficient means of connecting cables to batteries. Though not shown in FIG. 7, the joined connectors 31' and 50' are covered by a heat-shrinkable dielectric cover, as shown and described above.

An electric storage battery cable connector assembly is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An electric storage battery cell, comprising:

(a) a battery cell housing for containing positive and negative electrolytic battery plates;

(b) a battery cover for enclosing the top of the battery cell housing and including at least one battery terminal formed therein and communicating with the interior of the battery cell housing;

(c) a female connector electrically communicating with the battery terminal, said female connector being formed of an electrically-conductive material and having a recess therein;

(d) a male connector comprising an elongate, generally cylindrical, electrically-conductive post having a fixed end for being attached to an electrical cable and a free end for being received in the recess of the female connector, and cam means integrally-formed on the post of the male connector adjacent the free end; and (e) cam follower means carried in the recess of the female connector for cooperating with the cam means on the post of the male connector for relative rotational movement between an unlocked position where the post of the male connector may be inserted into or removed from the recess in the female connector, and a locked position where the post of the male connector is locked into the recess of the female connector against removal therefrom.

2. An electric storage battery cell according to claim 1, wherein the cam means of said the post comprises a generally annular nose having a flat side for allowing the post to move pass the cam follower, and an asymmetric annular groove of reduced diameter extending around the periphery of the post in communication with the flat side of the nose for receiving the cam follower as the post is rotated.

3. An electric storage battery cell according to claim 1, wherein battery terminal includes a lead housing within which said female connector is embedded for being connected to the battery terminal.

4. An electric storage battery cell according to claim 1, wherein said female connector is embedded in the battery terminal.

5. An electric storage battery cell according to claim 1, wherein said male connector rotates through an angle of 180 degrees between the locked and unlocked positions, and further wherein said cam means and said cam follower cooperate to create a wedging action thus preventing the male connector from rotating past an angle of 180 degrees when being moved from the unlocked to the locked position.

6. An electric storage battery cell according to claim 1, wherein the post of the male connector is oriented at a 90 degree angle to an electrical cable to which it is attached.

7. An electric storage battery cell according to claim 1, wherein said male connector post includes an elongate gap extending through the post along its length for providing a linear spring action which permits secure locking of the male connector with the female connector with less resistance and improved electrical contact.

8. An electric storage battery comprised of a plurality of electrically interconnected storage battery cells according to one of claims 1, 2, 3, 4, 5, 6 or 7.

9. A battery cover for enclosing the top of an electric storage battery cell housing and including at least one battery terminal formed therein for communicating with the interior of the battery cell housing to which it is attached, comprising:

(a) a female connector electrically communicating with the battery terminal, said female connector being formed of an electrically-conductive material and having a recess therein;

(b) a male connector comprising an elongate, generally cylindrical, electrically-conductive post having a fixed end for being attached to an electrical cable and a free end for being received in the recess of the female connector, and cam means integrally-formed on the post of the male connector adjacent the free end; and (c) cam follower means carried in the recess of the female connector for cooperating with the cam means on the post of the male connector for relative rotational movement between an unlocked position where the post of the male connector may be inserted into or removed from the recess in the female connector, and a locked position where the post of the male connector is locked into the recess of the female connector against removal therefrom.

* * * * *